United States Patent [19]

Matsubara

[11] Patent Number: 4,649,844

[45] Date of Patent: Mar. 17, 1987

[54] THREAD FEEDING APPARATUS FOR SEWING MACHINE

[76] Inventor: Toru Matsubara, 5-49-3 Fuda, Chofu-shi, Tokyo, Japan

[21] Appl. No.: 813,895

[22] Filed: Dec. 27, 1985

[30] Foreign Application Priority Data

Dec. 31, 1984 [JP] Japan ..... 59-280131
Dec. 31, 1984 [JP] Japan ..... 59-280132
May 24, 1985 [JP] Japan ..... 60-110210

[51] Int. Cl.[4] ..... B65H 57/00

[52] U.S. Cl. ..... 112/302; 112/270; 112/278

[58] Field of Search ..... 112/302, 270, 278, 273, 112/57

[56] References Cited

U.S. PATENT DOCUMENTS 4,215,641 8/1980 Dobrjanskyj et al. ..... 112/302
4,408,554 10/1983 Takiguchi et al. ..... 112/302
4,566,396 1/1986 Sakuma et al. ..... 112/302

FOREIGN PATENT DOCUMENTS 59-37985 3/1984 Japan ..... 112/302
59-37984 3/1984 Japan ..... 112/302

*Primary Examiner*—Ronald Feldbaum
*Attorney, Agent, or Firm*—Armstrong, Nikaido, Marmelstein & Kubovcik

[57] ABSTRACT

The invention relates to an apparatus for feeding thread in a sewing machine. The apparatus includes a thread feeding pass, a base tension disc, a thread holding device, an encoder, and a thread feeding device. The thread feeding device includes a presser roller and a feeding roller driven synchronously with a sewing needle. When a predetermined length of thread is fed to a thread take-up lever, the thread holding device is actuated to hold and stop the thread without stopping rotation of the thread feeding rollers such that the thread slips on the feeding rollers.

6 Claims, 8 Drawing Figures

THREAD FEEDING APPARATUS FOR SEWING MACHINE

BACKGROUND OF THE INVENTION

This invention relates to an apparatus for feeding thread in a sewing machine. In a conventional sewing machine, thread is fed by the reciprocating motion of a thread take-up lever. The length of thread fed is determined by friction from the tension disc in the thread pass. The tension disc is adjusted manually by an operator to match a sewing condition.

By analyzing the sewing mechanism, it has recently been found that the quantity of stitches sewn result in accurate control of the thread length fed to the needle.

In other words, by sensing the thickness of fabric sewn and the pitch of the stitch, an adequate length of thread fed can be calculated, and therefore, automated sewing is achieved.

An apparatus has already been proposed constituting a thread feeding roller which is driven by a stepping motor which is controlled to feed a proper length of thread to the needle for every stitching motion.

However, in this known apparatus, a longer length of thread tends to be fed by inertia, and this tendency is exaggerated in high speed sewing. Furthermore, when thick fabric is sewed, the tension created in the thread is increased which requires the stepping motor having a higher capacity. Therefore, there is a higher cost to manufacture the device, and the device is uneconomical to market.

PURPOSE OF THE INVENTION

The primary object of this invention is to provide a thread feeding apparatus for a sewing machine. The apparatus has a thread holding device controlled synchronously with a sewing needle and a thread feeding device.

Another object of this invention is to provide a measuring means which is incorporated with the thread feeding device, and feeds the exact length of thread needed to form a complete stitch.

Another object of this invention is to provide an alternate composition of the thread holding device.

SUMMARY OF THE INVENTION

These objects and other advantages are accomplished by the apparatus as described herein.

A thread feeding apparatus for a sewing machine has a thread guiding pass. The apparatus comprises a thread holding device for holding the thread when operated, an encoder for measuring the length of the thread fed, and a thread feeding device constituting a presser roller and a feeding roller driven synchronously with a sewing needle. When the feeding device feeds a predetermined length of the thread for completing one full stitch, the encoder generates a signal to actuate the thread holding device to hold and stop the thread without stopping rotation of the thread feeding roller.

Another feature of the invention incorporates an electromagnetic actuator for the thread holding device. In this feature, the electromagnetic actuator is actuated against a cap to hold the thread between the friction plate attached on top of the actuator and the cap. Still another feature of the invention includes the thread feeding device having a presser roller attached to an electromagentic actuator. The actuator is engaged when the thread holding device is actuated to pull the presser roller away from the feeding roller. In this manner, the thread is protected from wear by slipping on the rotating feeding roller.

BRIEF DESCRIPTION OF THE DRAWINGS

In the accompanying drawings, in which the same reference characters designate the same parts in the several views.

DESCRIPTION OF PREFERRED EMBODIMENTS

Figure 1:
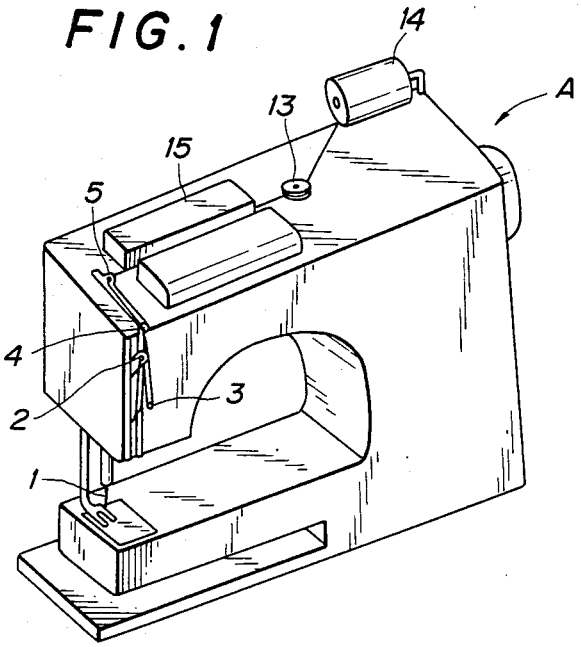
FIG. 1 is a perspective view of a sewing machine.
Figure 2:
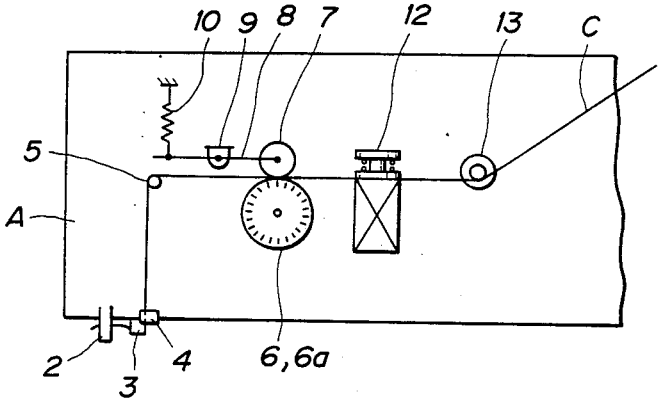
FIG. 2 is a schematic plan view of an embodiment of a thread feeding apparatus.
Figure 3:
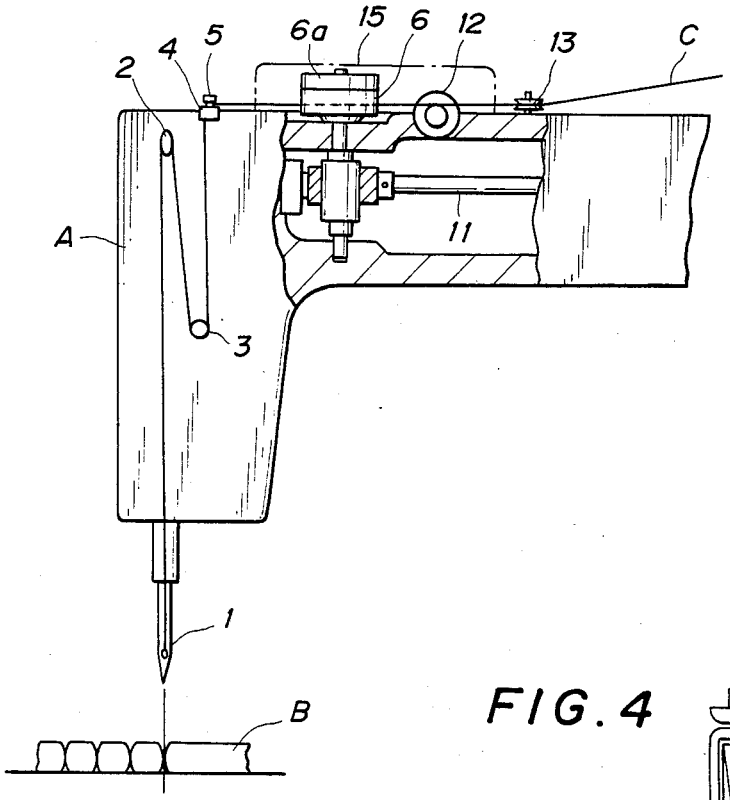
FIG. 3 is an elevation partial sectional view of the sewing machine head.

The explanation regarding the figures are as follows:

Referring to FIGS. 1–3, a sewing machine A comprises a needle 1, a thread take-up lever 2, thread guides 3, 4, 5, a thread feeding device composed of a feeding roller 6 and a presser roller 7, a thread holding device 12, a basic tension disc 13, and a spool 14. The presser roller 7 is installed at an end of a lever 8 which is supported by a pivot 9. The other end of lever 8 is engaged with a spring 10 which pushes the roller 7 towards the feeding roller 6. The feeding roller 6 is driven by a main drive shaft 11 of the sewing machine to synchronize the feeding speed of the thread to the sewing speed.

In this invention, the thread feeding cycle is controlled by electric devices which include an encoder 6a attached on the same axis of the feeding roller 6. The encoder is used to measure the length of thread fed by the roller 6. Thread C, supplied from spool 14, is guided by a basic tension disc 13. The thread runs through the thread holding device 12, and then to the thread feeding device. The basic tension disc 13 provides a small tension to thread C and the thread holding device holds thread C tight enough to stop thread feeding. The friction between presser roller 7 and feeding roller 6 is adjusted to feed thread C when the thread is not held by thread holding device 12. When thread C is held by the thread holding device, roller 6 slips on thread so that the thread is not fed.

Figure 4:
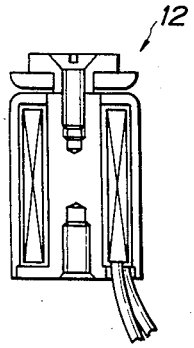
FIG. 4 is an elevation sectional view of a thread holding device.

According to FIG. 4, the thread holding device 12 is installed as an electromagnetic actuator. When the electromagnetic actuator is operated, the device 12 holds the thread. The thread supplying means are protected by a cover 15. The operation of this embodiment is summarized as follows.

When the sewing machine is operated, the main drive shaft 11 drives the thread feeding roller 6, and the thread supplied from the spool is fed through tension disc 13. Thread holding device 12 is in an unactuated condition so that the thread is fed to the thread take-up lever 2. When a predetermined length of thread, which makes one complete stitch, is supplied by the roller 6, the encoder 6a will signal the thread holding device 12.

Upon receiving the signal, the thread holding device is actuated and it holds the thread to stop the thread from being fed. The thread in the needle 1 is given a preferred tension by the thread take-up lever 2, while the needle 1 completes one full stitch. When one full stitch is completed, the thread holding device 12 is disengaged, and the roller 6 starts feeding the thread again. The thread feeding cycle is repeated while the sewing machine is being operated.

Figure 5:
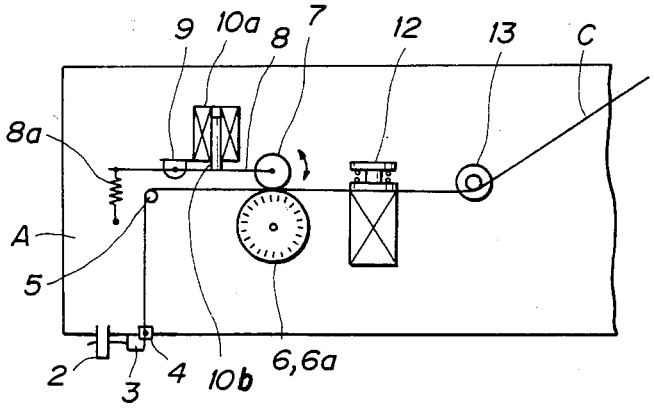
FIG. 5 is a schematic plan view of another embodiment of a thread holding device.

FIG. 5 shows another embodiment of the invention. This apparatus has the same means which are given the same numbers as the embodiment explained above, except for the presser roller means. In this embodiment, a presser roller 7 is held by an end of a lever 8 which is supported by a pivot 9. The other end of the lever 8 is attached to a spring 8*a* which pulls the presser roller 7 apart from the feeding roller 6.

An electromagnetic actuator 10*a* is located between the presser roller 7 and the pivot 9. When the actuator 10*a* is not operated, the presser roller 7 is pulled apart from the feeding roller 6 by the force of the spring 8*a*. As a result, the feeding roller does not feed the thread C. When the actuator 10*a* is operated, a piston pin 10*b* of the actuator is pulled down, and the pin presses the lever 8 so that the roller 7 is pushed onto the roller 6. The operation of this embodiment is explained as follows.

By starting the sewing machine, the actuator 10*a* is operated and the thread is pinched between the presser roller 7 and the feeding roller 6. The feeding roller 6, which is driven by the main shaft of the machine, feeds the thread C toward the thread take-up lever 2. When a predetermined length of thread, which makes one complete stitch, is supplied by the roller 6, the encoder 6*a* will signal the actuator 10*a* and the thread holding device 12. Upon receiving the signal, the actuator 10*a* is deactivated and the presser roller 7 is freed from the feeding roller 6 by the force of the spring 8*a*. At the same time, the thread holding device 12 is operated to stop the thread feeding. After one full stitch is completed, the same procedures are repeated to supply the thread by a stepping motion. In this embodiment, the presser roller 7 is pulled away from the rotating roller 6 while in the deactivated state, so that the thread is protected from wear damage.

Figure 6:
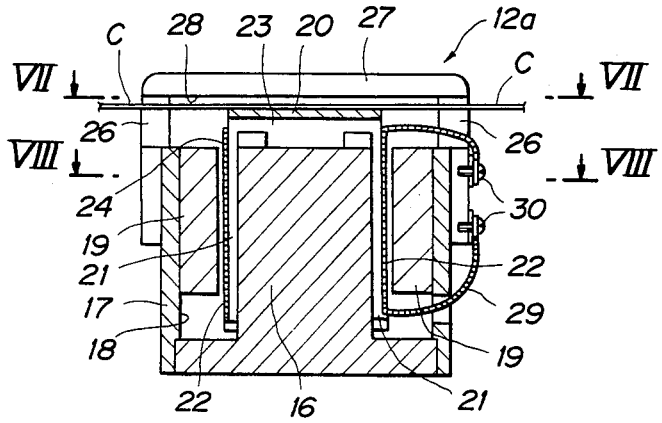
FIG. 6 is an elevation sectional view of an alternate embodiment of a thread holding device.
Figure 7:
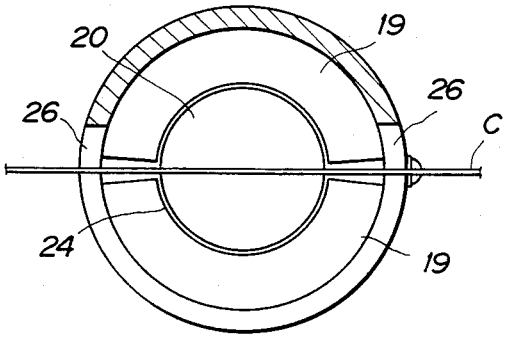
FIG. 7 is a sectional view along line VII—VII of FIG. 6.
Figure 8:
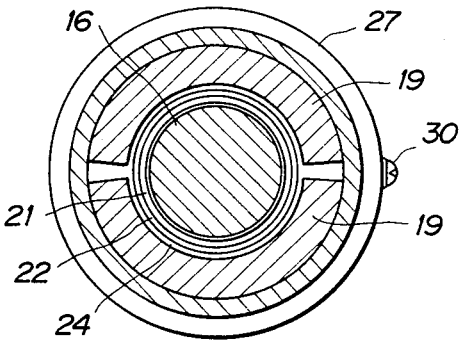
FIG. 8 is a sectional view along line VIII—VIII of FIG. 6.

FIGS. 6–8 show an alternate embodiment of the thread holding device. A thread holding device 12 has a base body 16 composed of a cylindrical yoke 17. A couple of magnets 19 are attached to the inner surface of the cylindrical yoke 17. A moving coil 23 is composed to a sliding element 21 with a coil 22. A friction plate 20 is mounted on the moving coil 23 and engaged in a gap 24 between the base body 16 and the magnet 19. An anti-magnetic material cap 27 is secured to the outer surface of the cylindrical yoke 17. The cap 27 is located above the friction plate 20 of the moving coil 23. The gap 24 allows thread C to be guided between the friction plate and the cap. An opening 26 is provided for guiding thread C into the cap 27. The magnet coil 22 is connected to a wire 29 and to terminals 30. This thread holding device 12*a* is used in the same manner as the device described in the former embodiment.

The thread C is guided in about a 1 mm gap maintained by the rear surface 28 of the cap 27 and the friction plate 20. Thread C is held tightly between the rear surface 28 and the friction plate 20 when the moving coil 23 is raised when it is energized. The thread C is freed from the holding device when the moving core is de-energized which allows the thread to be again fed by the feeding roller. The moving coil is given a small return force when disengaged to maintain a gap to ease setting the thread. Since the present device is a compact mechanism with a small inductance, it provides a quick response and is preferred in a high speed sewing machine. The moving coil in the magnetic gap 24 is driven with the same force that could drive a longer stroke. Therefore, the thread holding force is not influenced by the size of the thread and is controlled by changing the electric current.

As described above, in this invention the thread is supplied by an ever rotating feed roller, and by holding the thread with the thread holding device after a predetermined length of thread which makes on stitch is supplied. The feed roller continues rotating so that it will slip on the thread. Therefore, both high speed and high precise thread feeding can be achieved by a simple mechanism with the pressure roller, the feeding roller, the encoder to measure the thread fed and the thread holding device.

I claim:

1. An apparatus for feeding thread for a sewing machine comprising:

a thread feeding pass for guiding said thread from a thread spool to a take-up lever of said sewing machine, a base tension disc located adjacent to said thread spool, a thread holding device for holding said thread when said sewing machine is operated, an encoder for measuring the length of said thread fed, and a thread feeding device constituting a presser roller and a feeding roller driven synchronously to a sewing needle to feed said thread to said sewing needle, wherein a predetermined length of said thread for completing one full stitch is fed to said thread take-up lever, said thread holding device is actuated to hold and to stop said thread without stopping rotation of said thread feeding roller wherein said thread slips on said thread feeding roller.

2. The apparatus as defined in claim 1, wherein said thread holding device includes an electro-magnetic actuator.

3. The apparatus as defined in claim 1, wherein said encoder is attached on the same axis as the thread feeding roller and the thread feeding length measuring cycle is triggered by an electric signal which releases the thread holding device.

4. The apparatus defined in claim 1, wherein said presser roller is attached to an electro-magnetic actuator which pulls away from the thread feeding roller upon receiving the electric signal from the thread feeding device being engaged.

5. A thread holding device comprising:

a base body including a cylindrical yoke, at least one magnet attached to the inner surface of said cylindrical yoke, a moving coil associated between said base body and said magnet, a friction plate located on top of said moving coil, a cap secured on top of said cylindrical yoke, and a gap formed between said cap and said friction plate for guiding said thread.

6. An apparatus for feeding thread for a sewing machine comprising:

a thread feeding pass for guiding said thread from a thread spool to a take-up lever of said sewing machine, a base tension disc located adjacent to said thread spool, a thread holding device for holding said thread when said sewing machine is operated, said thread holding device including a base body including a cylindrical yoke, at least one magnet attached to the inner surface of said cylindrical yoke, a moving coil associated between said base body and said magnet, a friction plate located on top of said moving coil, a cap secured on top of said cylindrical yoke, and a gap formed between said cap and said friction plate for guiding said thread, an encoder for measuring the length of said thread fed, and a thread feeding device constituting a presser roller and a feeding roller driven synchronously to a sewing needle to feed said thread to said sewing needle, wherein when a predetermined length of said thread for completing one full stitch is fed to said thread take-up lever, said thread holding device is actuated to hold and to stop said thread without stopping rotation of said thread feeding roller such that said thread slips on said thread feeding roller.

* * * * *